US005929393A

United States Patent [19]

Jeter, Jr.

[11] Patent Number: 5,929,393

[45] Date of Patent: Jul. 27, 1999

[54] SPEAKER CABINET WITH SOUNDING BOARD

[76] Inventor: Charles W. Jeter, Jr., 314 E. Spring, Haynesville, La. 71038

[21] Appl. No.: 08/680,299

[22] Filed: Jul. 12, 1996

[51] Int. Cl.[6] ..... A47B 81/06

[52] U.S. Cl. ..... 181/199; 181/156; 181/154; 181/160

[58] Field of Search ..... 181/148, 154, 181/155, 156, 160, 199; 381/88, 90, 158, 159

[56] References Cited

U.S. PATENT DOCUMENTS

| | | | |
|---|---|---|---|
| 3,799,286 | 3/1974 | Carroll . | |
| 3,818,138 | 6/1974 | Sperrazza . | |
| 4,142,604 | 3/1979 | Smith | 181/156 |
| 4,398,619 | 8/1983 | Daniel | 181/156 |
| 4,714,133 | 12/1987 | Skaggs, Jr. | 181/160 |
| 4,730,694 | 3/1988 | Albarino | 181/199 X |
| 5,436,977 | 7/1995 | Sato | 181/199 X |

*Primary Examiner*—Khanh Dang

*Attorney, Agent, or Firm*—John M Harrison

[57] ABSTRACT

An audio speaker cabinet or enclosure having a sounding board and air space for enhancing the quality of sound produced by the speaker cabinet. The speaker enclosure is characterized in a preferred embodiment by a rectangular cabinet having a sounding board mounted in the cabinet enclosure interior between the front and rear panels of the enclosure, closely spaced with respect to the rear panel. A resilient membrane such as a sheet of vinyl is mounted on the front surface of the sounding board over an opening in the sounding board behind the speaker. A bass slot is included in the front panel below the speaker for air circulation into and from the enclosure interior and facilitating the attentuated sound produced by the vinyl sheet on the sounding board. In another embodiment, the vinyl sheet covers an opening provided in substantially the entire front surface of the sounding board and an air opening is provided in the rear panel for relieving pressure on the vinyl sheet as the sound from the speaker applies pressure to it. In still another embodiment the bottom edges of each of the side panels of the speaker cabinet or enclosure are bevelled or the cabinet bottom is angled rearwardly, such that the speaker cabinet leans in a rearward configuration for superior sound distribution effects.

8 Claims, 2 Drawing Sheets

FIG. 4
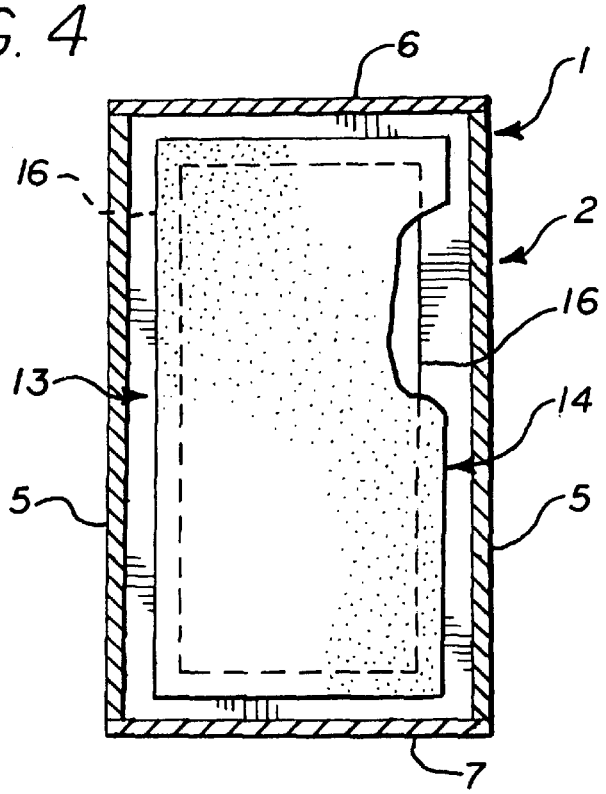
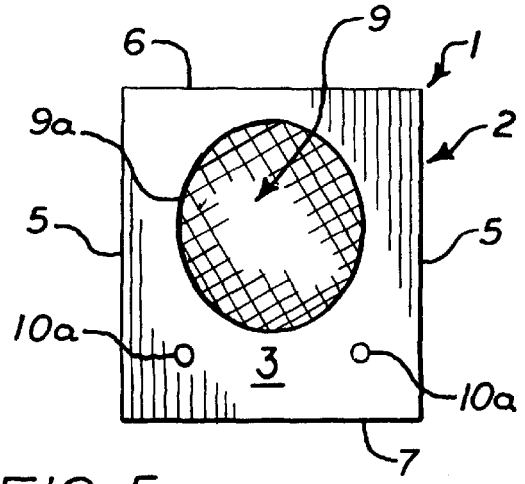
FIG. 5
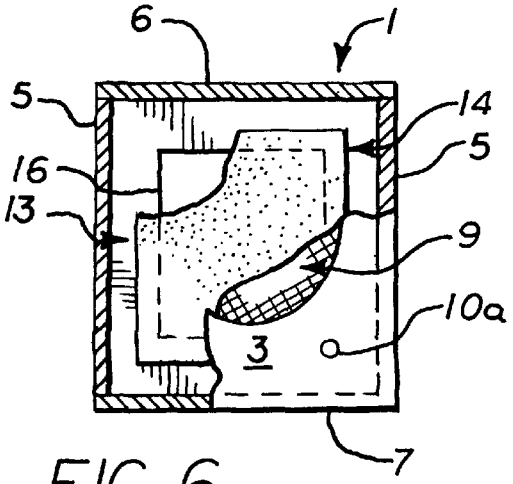
FIG. 6

SPEAKER CABINET WITH SOUNDING BOARD

BACKGROUND OF THE INVENTION

1. Field of the Invention

This invention relates to audio speakers and more particularly, to an audio speaker cabinet or enclosure having a sounding board or partition dividing the interior of the speaker cabinet for enhancing the quality of the sound produced by the speaker or speakers mounted in the speaker enclosure. In a preferred embodiment the speaker cabinet is characterized by a conventional speaker cabinet of selected size and proportions, having a bottom panel, a pair of side panels extending upwardly in spaced relationship from the bottom panel and front and rear panels extending upwardly from the front and rear edges of the bottom panel, with a top panel mounted on the front, rear and side panels, defining an enclosure interior. An audio speaker of selected size and design is mounted in the front panel of the enclosure and a rectangular partition or sounding board is mounted in the interior, in spaced relationship with respect to the rear panel. A flexible, resilient membrane such as a sheet of vinyl or other elastomeric material is mounted on the front surface of the partition over an opening in the partition and behind the speaker. In a preferred embodiment a bass slot, preferably upwardly bevelled from front to rear, is provided in the front panel beneath the speaker. The vinyl sheet covering the speaker partition surprisingly greatly enhances the sound quality produced by the speaker and the resulting attentuated sound is emitted primarily from the enclosure interior through the base slot. Respective aligned wire openings are provided in the partition and rear panel for allowing the speaker wire to travel from the enclosure interior to the enclosure exterior. In another embodiment, particularly with respect to those speaker cabinets having a small size such as car stereo speakers, the flexible membrane covers a partition opening which extends across substantially the entire front surface of the partition or sounding board and an air opening may be provided in the rear panel of the speaker cabinet for relieving pressure on the vinyl sheet produced by the speaker. In still another embodiment, the bottom edges of the side panels of the enclosure or the enclosure bottom are inclined, such that the speaker cabinet leans rearwardly to facilitate superior sound distribution effects.

In the manufacture of audio speaker cabinets and particularly those intended for use in "home entertainment" type applications, a variety of factors have been considered and implemented in order to produce cabinets which produce optimum sound and yet can be sold for a reasonable price. Among these factors include the number and kind of speakers mounted in the cabinets, the geometry and size of the speakers and the speaker cabinets and those elements effecting the structural quality, physical appearance and cost of the product, such as the type and quality of materials of construction and the mode of construction and assembly. The speaker cabinet of this invention provides a simple, yet effective construction for enhancing the sound quality produced by a single speaker mounted in the cabinet, by producing more mellow, resonating tones than conventional speakers, while increasing the distinctive quality of both music and vocal sound reproduction.

2. Description of the Prior Art

Various speaker cabinet designs are known in the art for enhancing the quality of sound produced by a speaker or speakers mounted in the cabinet. U.S. Pat. No. 3,799,286, dated Mar. 26, 1974, to James C. Carroll, describes a "Loud Speaker" characterized by multiple side panels disposed in the configuration of a polygon such as a pentagon. Multiple speakers are mounted in the panels and a grill cloth is mounted on the exterior of the panels and covers the speakers. A "Barrel-Shaped Speaker Enclosure" is detailed in U.S. Pat. No. 3,818,138, dated Jun. 18, 1974, to Augustine J. Sperrazza, Jr. The enclosure has a barrel configuration and multiple speakers mounted around the periphery of the enclosure. The curved shape of the speaker enclosure provides substantial improvement in sound reproduction and, combined with multiple speakers, produces an omnidirectional sound source that projects breadth as well as depth in phonetic reproduction.

An object of this invention is to provide a new and improved speaker cabinet or enclosure which utilizes a sounding board and membrane for enhancing the quality of sound produced by a speaker or speakers mounted in the cabinet or enclosure.

Another object of this invention is to provide a speaker cabinet having a sounding board characterized by a partition mounted in the enclosure interior in close relationship with respect to the rear panel and including a flexible membrane such as a vinyl sheet mounted on the front surface of the partition over an opening in the partition behind the speaker, for producing mellow tones while increasing the distinctive quality of music and vocal sound reproduction emitted by the speaker or speakers mounted in the cabinet.

Still another object of this invention is to provide a speaker cabinet characterized by a cabinet or enclosure of selected size, shape and design and having a sounding board partition fitted with a membrane opening dividing the interior of the enclosure and including a resilient vinyl sheet covering the opening, which extends across a selected area of the partition for improving the quality of sound produced by one or more speakers mounted in the enclosure.

A still further object of the invention is to provide a new and improved speaker enclosure and sound system which includes an enclosure or cabinet of selected design, a single speaker mounted in the cabinet, a sound-emitting slot provided in the cabinet beneath the speaker, a partition provided in the cabinet near and substantially parallel to the rear cabinet wall and an opening of selected size in the partition, as well as a flexible, resilient membrane such as a vinyl sheet having a thickness of a few mils, mounted on the partition over the opening to attentuate and enhance the sound from the speaker.

SUMMARY OF THE INVENTION

These and other objects of the invention are provided in a new and improved audio speaker cabinet or enclosure having a substantially rigid partition or sounding board mounted in the cabinet interior adjacent to, but closely spaced from the rear panel of the enclosure and including a flexible, resilient sheet of vinyl or other elastomeric material mounted on the front surface of the partition over a partition opening of selected size behind a single speaker mounted in the front panel of the speaker cabinet, for enhancing the quality of sound produced by the speaker. A bass slot is provided in the front panel of the enclosure below the speaker for effecting air circulation to and from the cabinet interior and emitting the attentuated sound developed by the vinyl sheet in the enclosure interior. Respective wire openings are provided in the partition and rear panel of the enclosure, through which the electrical wiring from the speaker passes for attachment to an amplifier system. In another embodiment, particularly in the case of small speakers such as those used in car stereo systems, the vinyl sheet covers an opening in the partition which encompasses substantially the entire front surface of the partition and an air opening is provided in the rear panel for relieving pressure on the vinyl sheet as the sound from the speaker applies pressure to it. In still another embodiment the bottom edges of the side panels or the bottom of the enclosure, or both have a slanted configuration, such that the enclosure is inclined rearwardly when resting on a flat surface for facilitating superior sound distribution effects.

BRIEF DESCRIPTION OF THE DRAWINGS

The invention will be better understood by reference to the accompanying drawing, wherein:

FIG. 4 is a front sectional view of the sounding board element of another embodiment of an alternative preferred embodiment of the speaker cabinet with sounding board;

FIG. 5 is a front view of still another embodiment of the speaker cabinet with sounding board; and FIG. 6 is a front sectional view of the speaker cabinet with sounding board illustrated in FIG. 6.

DESCRIPTION OF THE PREFERRED EMBODIMENTS

Figure 1:
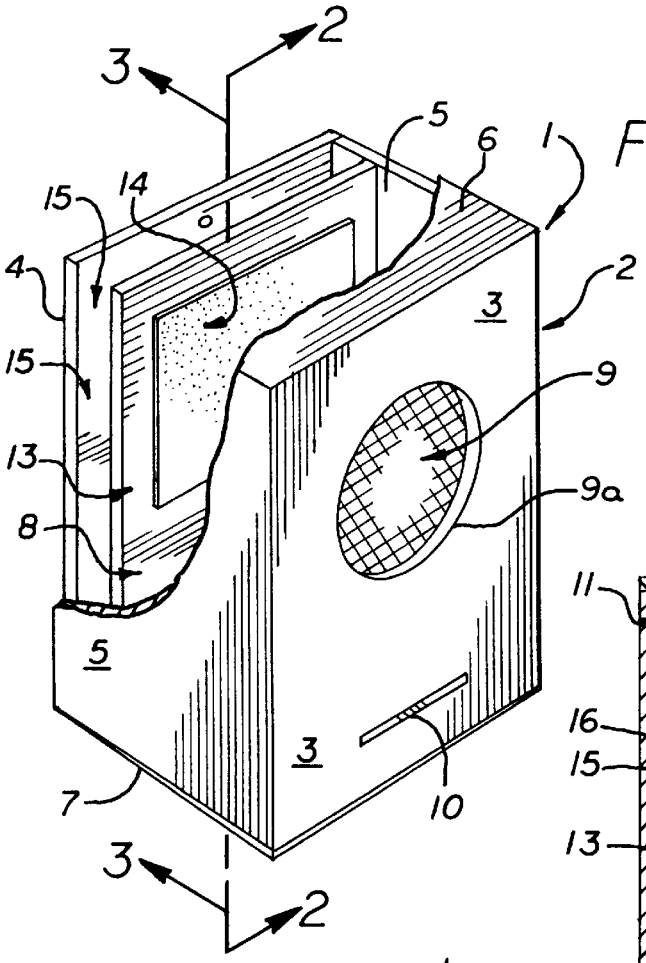
FIG. 1 is a perspective view, partially in section, of a preferred embodiment of the speaker cabinet with sounding board of this invention.
Figure 2:
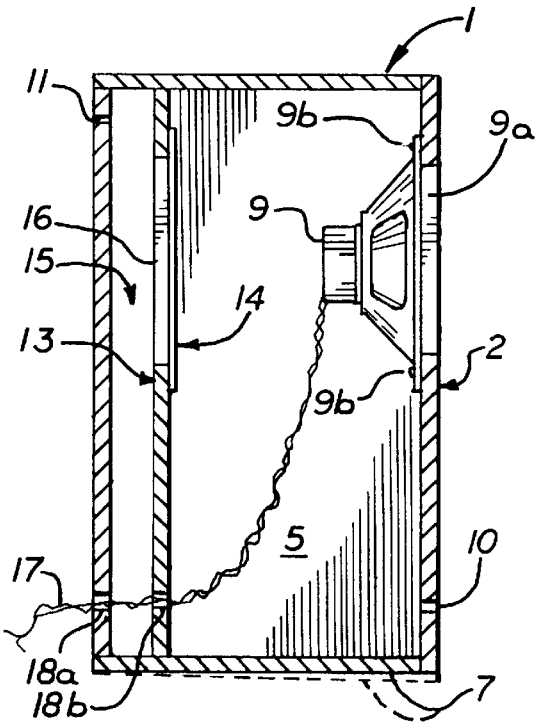
FIG. 2 is a sectional view, taken along line 2—2 of the speaker cabinet with sounding board illustrated in FIG. 1.
Figure 3:
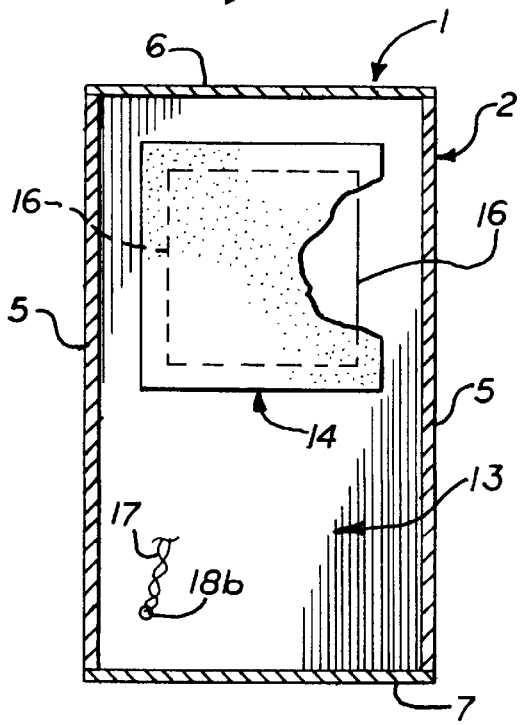
FIG. 3 is a sectional view, taken along line 3—3 of the speaker cabinet with sounding board illustrated in FIG. 1.

Referring initially to FIGS. 1–3 of the drawing, in a preferred embodiment the speaker cabinet with sounding board, hereinafter referred to as the speaker cabinet, of this invention is generally illustrated by reference numeral 1. The speaker cabinet 1 is typically characterized by a generally box-shaped cabinet enclosure 2, having a bottom panel 7, with a pair of side panels 5 extending upwardly in spaced, parallel relationship with respect to each other from the side edges thereof. A front panel 3 extends upwardly from the front edge of the bottom panel 7 and a rear panel 4 extends upwardly from the rear edge of the bottom panel 7, parallel to the front panel 3, as illustrated in FIG. 1. A top panel 6 rests on the upper edges of the side panels 5, front panel 3 and rear panel 4 and closes the speaker cabinet 1, thus defining a cabinet interior 8. A single speaker 9 is mounted by means of mount screws 9*b* in a speaker opening 9*a* provided in the front panel 3 and speaker wiring 17 extends from the speaker 9. A horizontal bass slot 10 is included in the front panel 3, beneath the speaker 9 and the bass slot 10 communicates with the cabinet interior 8. In a most preferred embodiment of the invention the bass slot 10 is bevelled upwardly from outside to inside the cabinet interior 8 to enhance the esthetics of the speaker cabinet 1. A substantially rigid, rectangular sounding board 13 is sealed in the cabinet interior 8 between the side panels 5, bottom panel 7 and top panel 6 to define a narrow air space 15 and is fitted with a sounding board opening 16. A generally rectangular membrane or sheet 14, constructed from a resilient, flexible, elastomeric material such as vinyl, is mounted on the front surface of the sounding board 13, directly behind the speaker 9. In a most preferred embodiment the vinyl sheet 14 is glued and/or stapled or tacked to the sounding board 13 after smoothing of the vinyl sheet wrinkles, in a non-stretched or tensioned application. As illustrated in FIGS. 1 and 2, a sounding board wiring opening 18*b* extends through the sounding board 13 and an aligned rear panel wiring opening 18*a* likewise extends through the rear panel 4, through which sounding board wiring opening 18*b* and rear panel wiring opening 18*a* the speaker wiring 17 passes from the cabinet interior 8 to a conventional receptacle pair or directly to a conventional amplifier or stereo system (not illustrated) located outside the cabinet enclosure 2.

Referring next to FIGS. 5 and 6 of the drawing, in a second preferred embodiment of the invention, in which the speaker cabinet 1 is smaller for use in a vehicle, for example, the flexible, resilient vinyl sheet 14 preferably covers a sounding board opening 16 in substantially the entire front surface of the sounding board 13. In this case, sound of excellent quality can be generated from a small cabinet enclosure 2 by increasing the size of the vinyl sheet 14 in proportion to the size of the cabinet enclosure 2.

As further illustrated in FIGS. 5 and 6 of the drawing, in another embodiment the bass slot 10 is replaced by a pair of spaced bass openings 10*a*, which in certain design applications and speaker sizes, further adds to the enhanced sound quality of the speaker 9. As illustrated in FIG. 2, one or more air openings 11 can also be provided in the cabinet enclosure 2, especially in the rear panel 4, for relieving pressure on the vinyl sheet 14 and further alternating the sound generated from the cabinet enclosure 2.

Referring again to FIGS. 1 and 2 of the drawing, the bottom edge of each one of the side panels 5 and/or the bottom panel 7 may be slanted or sloped such that the cabinet enclosure 2 cants rearwardly when resting on a flat surface. The rearwardly-canted configuration of the cabinet enclosure 2 facilitates superior sound distribution of the sound emitted by the speaker 9 and alternated by the vinyl sheet 14.

It will be understood by those skilled in the art that while the sounding board opening 16 is typically square or rectangular, as illustrated in FIG. 1, it may likewise be round or elliptical, as desired, so long as it is covered by the vinyl sheet 14 or an equivalent flexible membrane of sufficient flexibility and resiliency to vibrate or pulsate with the air in the cabinet interior 8, which air is set in motion by operation or "driving" of the speaker 9. Furthermore, it has also been found that the sounding board 13 should be positioned at a distance from about one-half of an inch to about one inch from the rear panel 4, and most preferably, about ¾ of an inch, to create an air space 15 of optimum volume and attentuate the sound from the speaker 9 in an optimum manner.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A speaker cabinet comprising an enclosure having a bottom panel, a pair of side panels upward-standing from said bottom panels in spaced relationship, with the bottom edges of said side panels inclined downwardly from front to rear, a rear panel upward-standing from said bottom panel, a front panel having at least one bass slot, said front panel upward-standing from said bottom panel in spaced relationship with respect to said rear panel and said front panel longer than said rear panel, a top panel carried by said side panels, with said front panel, said side panels, said top panel and said rear panel defining an enclosure which is tilted with said front panel inclined upwardly and said enclosure defining an enclosure interior; a speaker mounted in said front panel and speaker wiring connected to said speaker for electrically energizing said speaker; a partition mounted between said side panels in said enclosure interior in closely spaced relationship with respect to said rear panel for dividing said enclosure interior; an opening provided in said partition and a sheet of flexible material mounted on said partition, said sheet of flexible material covering said opening, for enhancing the quality of sound from said enclosure.

2. The speaker cabinet of claim 1 wherein said opening covers substantially the entire surface of said partition.

3. The speaker cabinet of claim 1 comprising a first wiring opening provided in said partition and a second wiring opening provided in said rear panel for receiving said speaker wiring.

4. The speaker cabinet of claim 1 wherein said opening covers substantially the entire surface of said partition and comprising a first wiring opening provided in said partition means and a second wire opening provided in said rear panel for receiving said speaker wiring.

5. The speaker cabinet of claim 1 wherein said flexible material comprises a sheet of plastic.

6. The speaker cabinet of claim 5 wherein said sheet of plastic comprises vinyl.

7. The speaker cabinet of claim 6 comprising a first wiring opening provided in said partition and a second wiring opening provided in said rear panel for receiving said speaker wire.

8. A speaker cabinet comprising an enclosure having a bottom panel, a pair of side panels upward-standing from said bottom panel in spaced relationship, a rear panel upward-standing from said bottom panel, a front panel having a bass slot, said base slot bevelled from front to rear and said front panel upward-standing from said bottom panel in spaced relationship with respect to said rear panel and a top panel carried by said side panels, with said front panel, said side panels, said top panel and said rear panel defining an enclosure interior; a speaker mounted in said front panel, said speaker extending into said closure interior, and a speaker wire connected to said speaker for electrically energizing said speaker; a partition vertically sealingly mounted in said side panels, between said top panel and said bottom panel in said enclosure interior in closely spaced relationship and parallel with respect to said rear panel for dividing said enclosure interior; an opening provided in said partition; and a sheet of vinyl mounted on said partition, said vinyl covering said opening and at least a portion of said partition behind said speaker, for enhancing the quality of sound from said speaker.

* * * * *